US005977857A

United States Patent [19]

Hashimoto et al.

[11] Patent Number: 5,977,857

[45] Date of Patent: Nov. 2, 1999

[54] CHIP INDUCTOR

[75] Inventors: Shunji Hashimoto, Kadoma; Mikio Taoka, Neyagawa; Hideo Nakano, Yawata, all of Japan

[73] Assignee: Matsushita Electric Industrial Co., Ltd., Osaka, Japan

[21] Appl. No.: 08/954,903

[22] Filed: Oct. 21, 1997

Related U.S. Application Data

[62] Division of application No. 08/412,562, Mar. 29, 1995, Pat. No. 5,748,065.

[30] Foreign Application Priority Data

Mar. 30, 1994 [JP] Japan ..... 6-060887

[51] Int. Cl.[6] ..... H01F 27/29; H01F 27/30

[52] U.S. Cl. ..... 336/192; 336/208

[58] Field of Search ..... 336/192, 198, 336/208, 96, 205

[56] References Cited

U.S. PATENT DOCUMENTS

| | | |
|---|---|---|
| 4,804,340 | 2/1989 | Hamer et al. . |
| 4,888,571 | 12/1989 | Kobayashi et al. . |
| 4,890,085 | 12/1989 | Saito et al. . |
| 4,939,494 | 7/1990 | Matsuda et al. . |
| 5,034,854 | 7/1991 | Matsumura et al. . |
| 5,165,056 | 11/1992 | Chien-heng . |
| 5,446,958 | 9/1995 | Hoang . |

FOREIGN PATENT DOCUMENTS

| | | |
|---|---|---|
| 0 177 759 | 4/1986 | European Pat. Off. . |
| 0 025 605 | 3/1991 | European Pat. Off. . |
| 57-162412 | 10/1982 | Japan . |
| 59-103315 | 10/1984 | Japan . |
| 60-260116 | 12/1985 | Japan . |
| 61-185905 | 8/1986 | Japan . |
| 3-27509 | 2/1991 | Japan . |
| 1-135915 | 7/1991 | Japan . |
| 3-219613 | 9/1991 | Japan . |

*Primary Examiner*—Thomas J. Kozma
*Attorney, Agent, or Firm*—McDermott, Will & Emery

[57] ABSTRACT

The object of the present invention is to provide a chip inductor structured for miniaturization, excellent mass-producibility and high reliability.

A chip inductor of a sealed type having a square-shaped winding comprises a bobbin for winding, which has a square-shaped flange on its both ends, and a metal terminal sticking out from the outer side surface of each respective flange and each respective metal terminal being bent inside each respective flange upward so as to stick out to the upper side surface of the flange, also have the foregoing metal terminal further bent along the upper side surface of the flange, and further make insert-molding of the foregoing bent terminal possible to form the bobbin for winding.

1 Claim, 8 Drawing Sheets

CHIP INDUCTOR

This application is a division of Ser. No. 08/412,562 filed Mar. 29, 1995, now U.S. Pat. No. 5,748,065.

BACKGROUND OF THE INVENTION

The present invention relates to a chip inductor for use in electronic equipment, communication equipment and the like.

In recent years, the functions and performance of various types of electronic equipment and communication equipment have been improved by using digital circuits and by employing higher in step with a remarkable progress of or improvements in semiconductor technologies. Inductors used in such various equipment are required to have much smaller dimensions like miniature chip type inductors and yet higher reliability.

Prior art chip inductors will be explained in the following:

FIG. 13 is a perspective view of a typical prior art chip inductor showing its internal structure.

In FIG. 13, a drum type bobbin 51 having a round flange on each end thereof attached by an adhesive 54 to two external terminals 53, each of which has an internal connection terminal 52.

The bobbin 51 is formed of ferrite, ceramics or resin.

A winding 55 is disposed around the bobbin 51, and one end of the winding 55 is attached to the internal connection terminal 52 by wrapping and further, with solder 56 being applied over the wrapping portion for secure connection.

An exterior enclosure 57 made of insulating resin or the like encases the whole above structure except for the external terminals 53.

FIG. 14 is a perspective view of another typical prior art chip inductor showing its internal structure.

In FIG. 14, a bobbin 51 and an external terminal 53 are put together by insert-molding. The rest of the structure is the same as shown in FIG. 13.

With the foregoing prior art structures, because of the drum type bobbin 51 having a round flange at both ends, there is much dead-space left within the outline contour containing the exterior enclosure 57, thereby imposing a limit on miniaturization.

Particularly, when the drum type bobbin is attached to the external terminals 53, slippages in the mutual positions are likely to take place and some extra space has to be set aside for the possible displacement, thereby causing this structure not to be so suitable for the miniaturization of chip inductors.

Besides, because the beginning and ending of the winding 55 are located on the same flange, the distribution capacitance between wound wires tends to increase extremely with a chip inductor of a small number of wire turns, resulting the deterioration of Q-Factor characteristics.

Also, the flange of the bobbin, at the side where the internal connection terminal 52 exists, is covered by the internal connection terminal 52 which is serving as a magnetic shield. As a result, magnetic fluxes are interrupted and Q-Factor characteristics are further deteriorated.

Further, when the bobbin is made of ferrite or ceramics, it has not been easy to produce the bobbin to required shapes, since the configurations of the bobbin are usually rather complex.

SUMMARY OF THE INVENTION

A chip inductor of the present invention comprises:

(a) a bobbin having a square-shaped flange formed on each of both ends;

(b) a metal plate terminal, possessing (1) a first end part which protrudes from the external side surface of the foregoing flange, (2) a second end part which protrudes from the upper side surface of the foregoing flange and further is bent along the same upper side surface, and (3) an embedded portion formed within the foregoing flange; and (c) a winding disposed around the foregoing bobbin, and, further, an end part of the foregoing winding is connected to the second end part of the foregoing metal terminal.

As pointed out in greater detail below *** of this invention provides important advantages.

According to the above structures, the square-shape of the flanges formed at both ends of the bobbin contributes to the elimination of dead-space, thereby enabling to further miniaturize the chip inductor.

Besides, there is no need of connections, and by using adhesives, thereby saving extra space and facilitating further miniaturization of the chip inductor.

Also, each respective surface of the first end part and second end part of the metal plate terminal is separated from each other by the embedded portion, and when the end part of the winding is connected to the second end part of the metal terminal, the molten solder attached to the second end part does not flow out along the metal terminal of the embedded portion, hence making it rather difficult for the thickness of the first end part to change by the influence of the flown out solder.

As a result, any adverse effects to the molding die are eliminated in the next production step of providing exterior enclosure molding.

Further, since the beginning and ending of the winding are located on different flanges of the bobbin, the chip inductor can be built without increasing the distribution capacitance between wires, thereby contributing to further improvement in the Q-Factor characteristics even when the number of wire turns is small.

The invention itself, together with further objects and attendance advantages, will best be understood by reference to the following detailed description taken in conjunction with the accompanying drawings.

DETAILED DESCRIPTION OF THE INVENTION

Details of the present invention will be explained with the help of examples in the following:

Example 1

Figure 1:
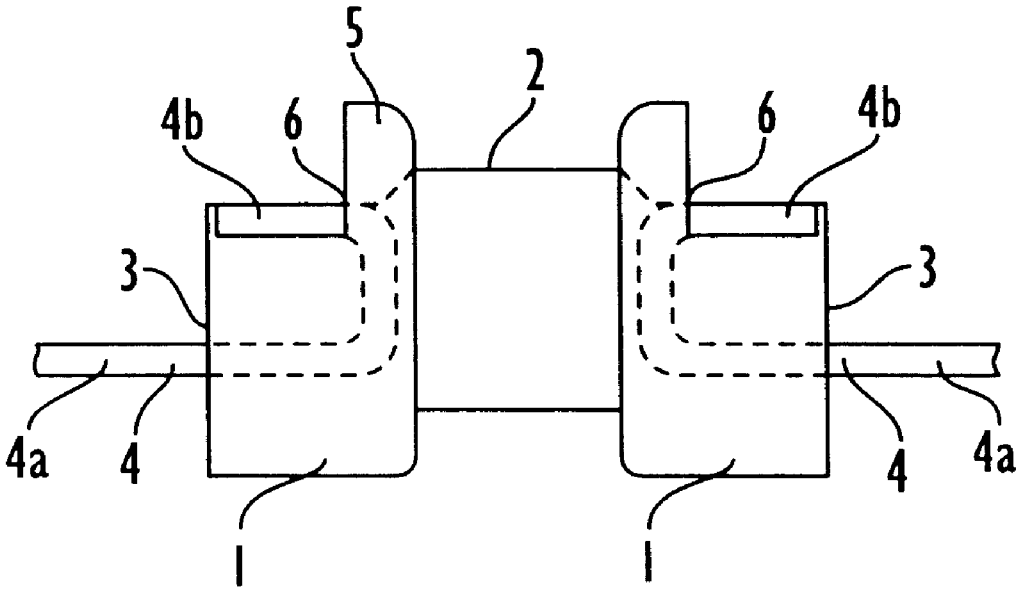
FIG. 1 is a see-through plan view of a bobbin for a winding, wherein metal terminals are insert-molded, showing an exemplified embodiment of the metal terminals and the bobbin for winding as used in a chip inductor of the present invention.

FIG. 1 is a see-through plan view of an exemplified embodiment of the metal terminals and bobbin for a winding as used in a chip inductor of the present invention.

Figure 2:
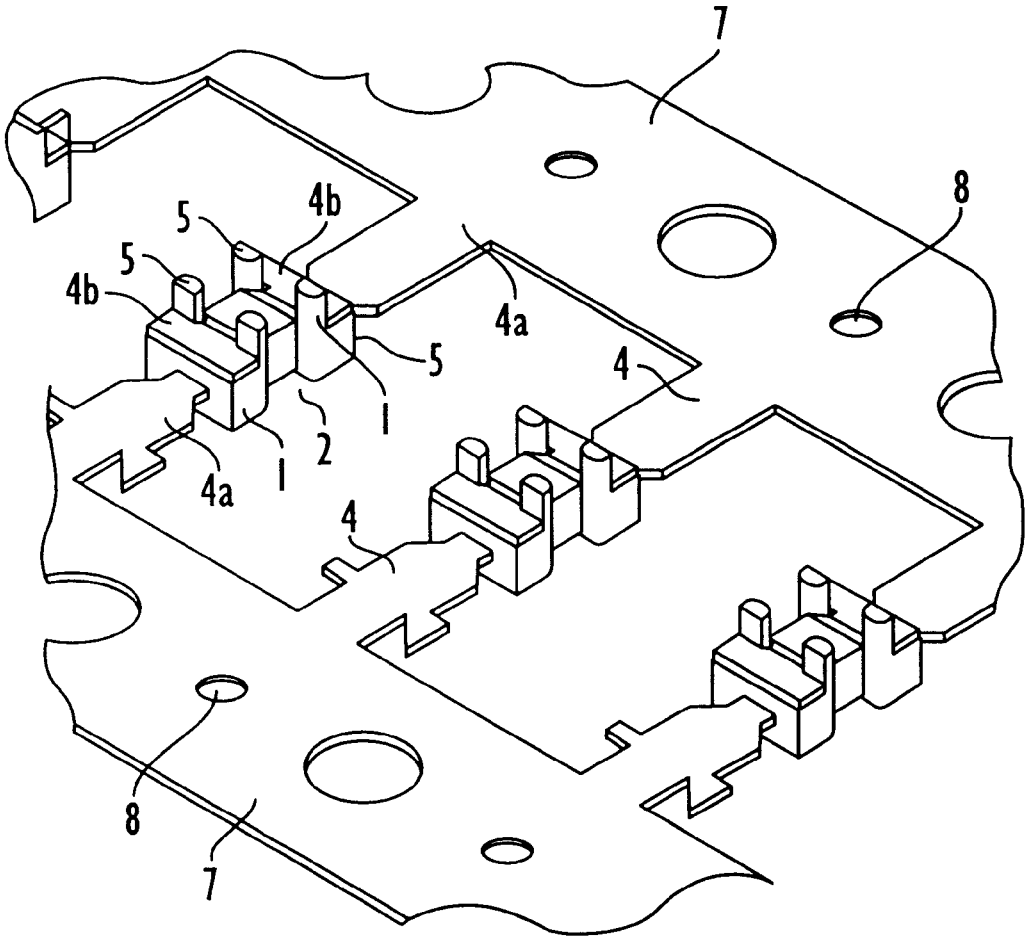
FIG. 2 is a perspective view of an exemplified embodiment of the manufacturing step for the metal terminals and bobbin for winding of FIG. 1.

FIG. 2 is a perspective view of an exemplified embodiment of the manufacturing step for producing the metal terminals and bobbin for a winding as used in a chip inductor of the present invention.

Figure 3:
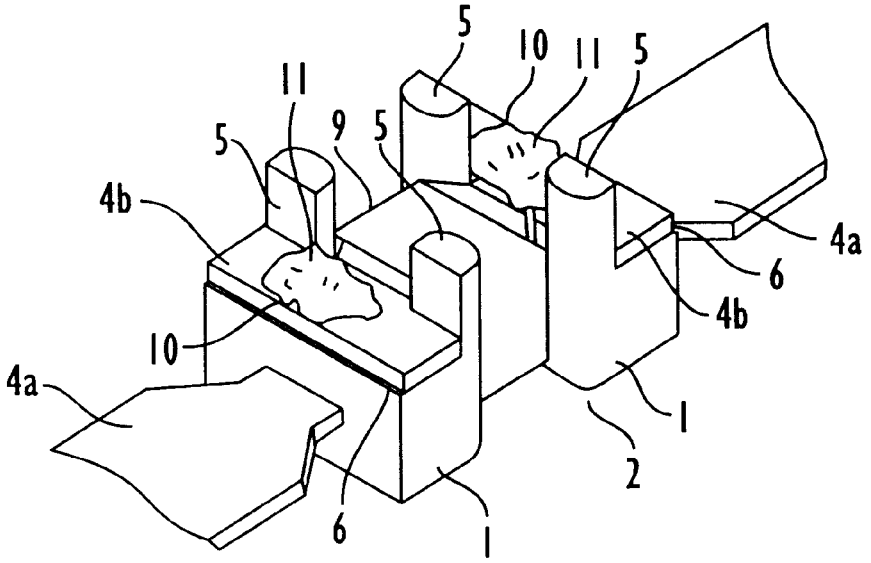
FIG. 3 is a perspective view of an exemplified embodiment of the present invention for a chip inductor after a winding is connected.

FIG. 3 is a perspective view of a chip inductor as an exemplified embodiment of the present invention after a winding is connected.

Figure 4:
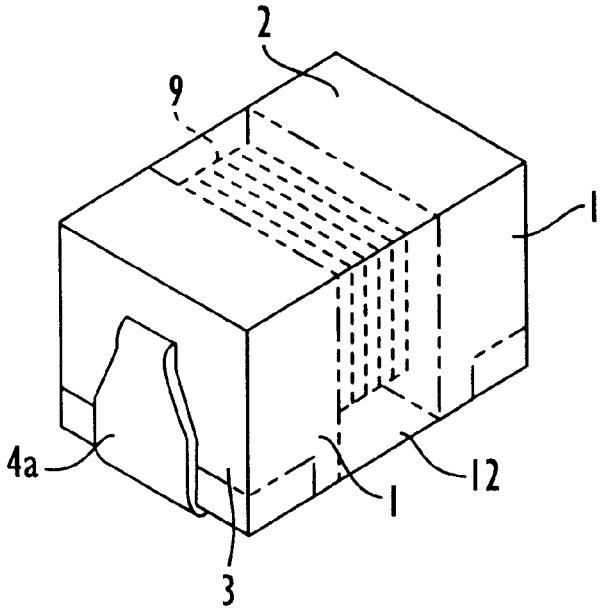
FIG. 4 is a perspective view of an exemplified embodiment of the present invention for a chip inductor after an exterior enclosure is formed, showing an example of an enclosed chip inductor.

FIG. 4 is a perspective view of an example of a chip inductor related to the present invention.

With respect to example 1, a chip inductor comprises a bobbin 2 with a flange 1 formed at each of the of the bobbin ends, a winding 9 disposed around the bobbin 2, metal terminals 4 to which each respective end of the winding 9 is connected, and an exterior enclosure 12 encasing the winding 9.

In FIG. 1, a square-shaped flange 1 is formed at both ends of a bobbin 2, respectively.

The bobbin 2 having the foregoing flange 1 is produced by using a resin material.

A resin used in this example is an electrically insulating and heat resistant resin such as polyphenylenesulfide, polyphenyleneoxide and liquid crystal polymer.

The metal terminal 4 is inserted in each respective flange 1 located at both ends of the bobbin 2, with a first end part 4*a* and second end part 4*b* of each respective metal terminal 4 sticking out from the flange 1.

The metal terminal 4 is bent upward inside of the flange 1 near its inner side, and the second end part 4*b* passes through the upper side surface 6 of the flange 1, and then is bent along the upper side surface 6.

The first end part 4*a* of the metal terminal 4 is, respectively, sticking out of the outer side surface 3 of the flange 1.

The metal terminal 4 is formed of such electro-conductive materials as phosphor bronze or iron and the like, plated with solder, silver or the like.

Two bumps 5 are formed, respectively, at the end of the inner side of the flange's 1's upper side surface 6. Guide grooves for disposing the winding 9 on the bobbin 2 are formed between those bumps 5.

In the manufacturing process of the present example, the metal terminal 4 is pre-formed to a specified shape before the metal terminal 4 is inserted into an insert molding die.

It is also possible that the shape-forming of the metal terminal 4 can be performed after the metal terminal 4 is inserted into the insert molding die.

In addition, for the purpose of preventing gates from remaining, at the time of molding the bobbin 2 for a winding, a gate cut is in place to close the gate and at the same time have it cooled down at the moment when the fluid resin for a insert-molding of the bobbin 2 for winding is filled in the molding die of the bobbin 2 for a winding. When a gate is left or remains at the time of insert-molding, extra spacing equal to the length of the gate has to be set aside in the subsequent step of encasing the bobbin in an exterior enclosure, thereby ending up hurting the stability of the encasing step.

Besides, when a gate cut is in place, a runner part and spruce part are made free inside the molding die after molding, and may be left remaining within the molding die.

To solve this problem, the transport section 7 of the metal terminal 4 has holes 8 arranged, as shown in FIG. 2, for the purpose of trapping the free runner part and spruce part. In place of the holes 8, cuts formed on the transport section 7 may work equally well.

As shown in FIG. 3, a winding 9 is disposed around the bobbin 2 which is inserted with the metal terminals 4.

Both ends 10 of the winding 9 are, respectively, connected to the second end part 4*b* situated on the upper side surface 6 of the flange 1 by solder 11.

The winding 9 used in the example is a urethane coated copper wire.

Then, as shown in FIG. 4, the whole assembly is encased in an exterior enclosure 12 made of a heat resistant and electrically insulating resin such as epoxy or the like.

Finally, the first end part 4*a* of the metal terminal 4 sticking out from the outer side surface 3 of the flange 1 is formed to a specified shape.

Thus, a chip inductor is completed.

According the foregoing structures in Example 1, the resultant chip inductor has achieved a reduction in the bottom area by about 50%, and in the volume by about 39% when compared with the prior art chip inductor.

Besides, when the both end parts 10 of the winding 9 and the second end part 4*b* of the metal terminal 4 are connected by soldering, the molten solder does not flow away along the metal terminal 4 because the metal terminal 4 situated on the upper side surface 6 of the flange 1 is appropriately separated from the first end part 4*a*.

Therefore, the thickness of the second end part 4*a* which is sticking out to the outer side surface 3 of the flange 1 is not affected by the molten solder to change, and when the exterior enclosure 12 is provided, such problems as destruction of the molding die or small solder particles squeezed in by the molding die will not occur.

Further, the beginning and ending of the winding 9 are located on different flanges, thereby realizing excellent Q-Factor characteristics even for a chip inductor of a small number of wire turns.

For example, with a chip inductor of 15 nH in inductance, Q-Factor characteristics are improved by about 20% over a prior art version with a resultant contribution to enhancement of the chip inductor performance.

With the present example, polyphenylenesulfide, liquid crystal polymer or the like is used as the material for the bobbin 2, and an electrically insulating and heat resistant resin such as epoxy or the like is used as the material for the exterior enclosure 12.

In place of the foregoing resins, use of a composite resin containing ferrite powder as the material for at least one of the bobbins 2 and exterior enclosure 12 may result in producing a chip inductor of much higher inductance.

For example, with a chip inductor of the same dimensions and a winding as the chip inductor of the present example, suppose the chip inductor uses a composite resin containing ferrite powder by 40 to 95 wt %. Then, the chip inductor shows inductance as high as about 1.5 to 10 times that of a chip inductor using a resin of with no ferrite powder content.

According to the foregoing structures a performance, which is equal to or better than that of a prior art chip inductor using a bobbin comprising a discrete ferrite core of magnetic permeability coefficient ranging from 10 to 90 has been achieved.

In this case, a bobbin 2 or exterior enclosure 12 of complicated shapes can be readily produced by injection molding or the like applied to composite resins.

Example 2

Figure 5:
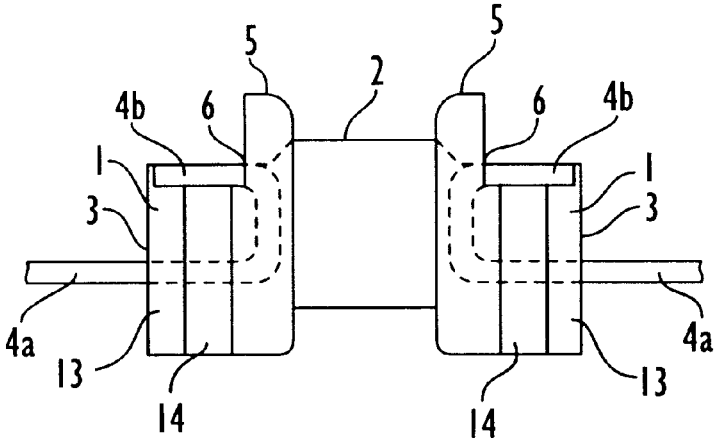
FIG. 5 is a see-through plan view of a bobbin for a winding, wherein metal terminals are insert-molded, showing another exemplified embodiment of the metal terminals and bobbin for winding as used in a chip inductor of the present invention.
Figure 6:
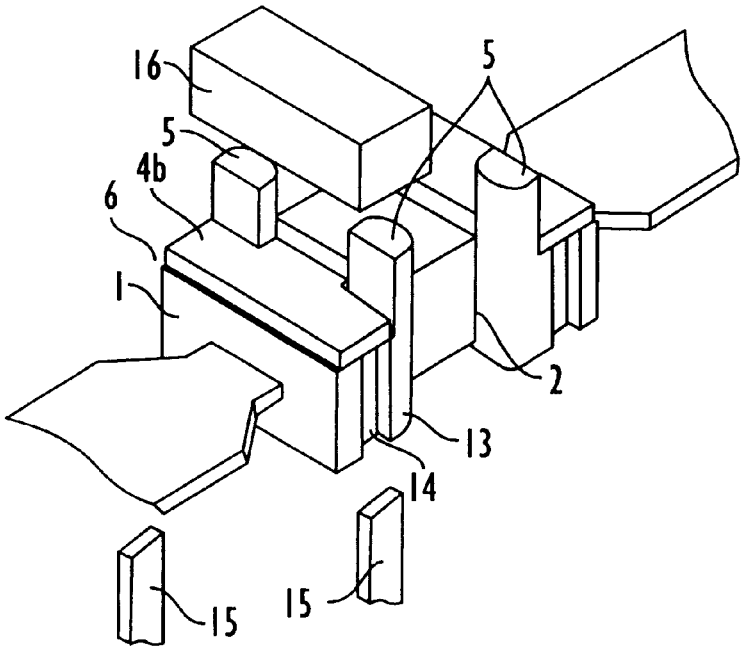
FIG. 6 is a perspective view of another exemplified embodiment of the manufacturing step for a the bobbin for winding as insert-molded for use in a chip inductor of the present invention.

A second exemplary embodiment of the present invention will be explained with the help of the drawings (FIGS. 5 and 6) in the following manner:

FIG. 5 is a see-through plan view of a second example of a bobbin for a winding, which is insert-molded for use in a chip inductor of the present invention, and FIG. 6 is a perspective view of a second example of the manufacturing process for a bobbin for a winding as insert-molded for use in a chip inductor of the present invention.

With respect to example 2, a chip inductor comprises a bobbin 2 which has a flange 1 formed at each of the ends of the bobbin, a winding 9 disposed around the bobbin 9 (as shown in FIG. 3), metal terminals 4 (FIG. 1), each of which is connected to each respective end of the winding 9, and an exterior enclosure 12 (FIG. 4) encasing the winding 9.

A square-shaped flange 1 is formed on each of the ends of the bobbin 2. The bobbin 2 having flanges 1 is produced by using a resin material of electrically insulating and heat resisting material.

A groove 14 is formed on each of the side surfaces 13, which are situated next to the upper side surface 6 of the flange 1. A metal terminal 4 is inserted into each respective flange 1 located on each of the ends of the bobbin 2, with a first end part 4*a* and second end part 4*b* of each respective metal terminal 4 sticking out of the flange 1.

The metal terminal 4 is being bent upward near the inner side within the flange 1, and the second end part 4*b* pierces through to the upper surface 6 of the flange 1.

The second end part 4*b* of the metal terminal 4 is bent on and along the upper surface 6 so as to cover the groove 14.

Each respective first end part 4*a* sticks out of the outer side surface 3 of the flange 1.

The metal terminal 4 is formed of an electro-conductive material of phosphor bronze, iron or the like plated with solder, silver and the like.

At this time, as illustrated in FIG. 6, the second end part 4*b* is placed between a first die 15 for forming the groove 14 and a second die 16 for pressing the second end part 4*b* of the metal terminal 4, which has been bent along the upper surface 6 of the flange 1, so as to cover the upper side surface 6 of the foregoing groove 14.

The bumps 5 are formed on the inner side end of the upper surface 6 of each flange 1 is the same as was described in Example 1.

Thus, by molding the bobbin 2 for a winding so as to have the metal terminal 4 placed between the first die 15 and second die 16, the position of the inserted metal terminal 4 can be accurately determined.

As a result, such troublesome cases, wherein the metal terminal 4 is bitten by the die or the like, encountered during insert-molding, can be avoided.

Besides, the molding process can be performed without having molding burrs formed on the second end part 4*b* of the metal terminal 4.

Therefore, in the same manner as experienced in Example 1, when an end part 10 of the winding 9, after it is disposed on the bobbin 1 as shown in FIG. 3, is connected to the second end part 4*b* of the metal terminal 4 by means of solder 11, the connection can be performed securely without adverse effects caused by burning of the afore-mentioned molding burrs or forming of insulating films.

As a result, the connection stability is much enhanced, thereby contributing to achieving high reliability.

In the present example, the metal terminal 4 is formed in advance almost to the required shape before it is placed in the insert-molding die, and then it is placed between the first die 15 and second die 16 for forming exactly to the specified shape.

Then, in the same way as was in Example 1, an exterior enclosure 12 formed of a heat resistant resin, such as epoxy and the like, is provided as illustrated in FIG. 4.

Finally, the first end part 4*a* of the metal terminal 4 sticking out from the outer side surface 3 of the flange 1 located at each respective end of the bobbin 2 for winding is formed.

Thus, a chip inductor is completed.

Example 3

Figure 7:
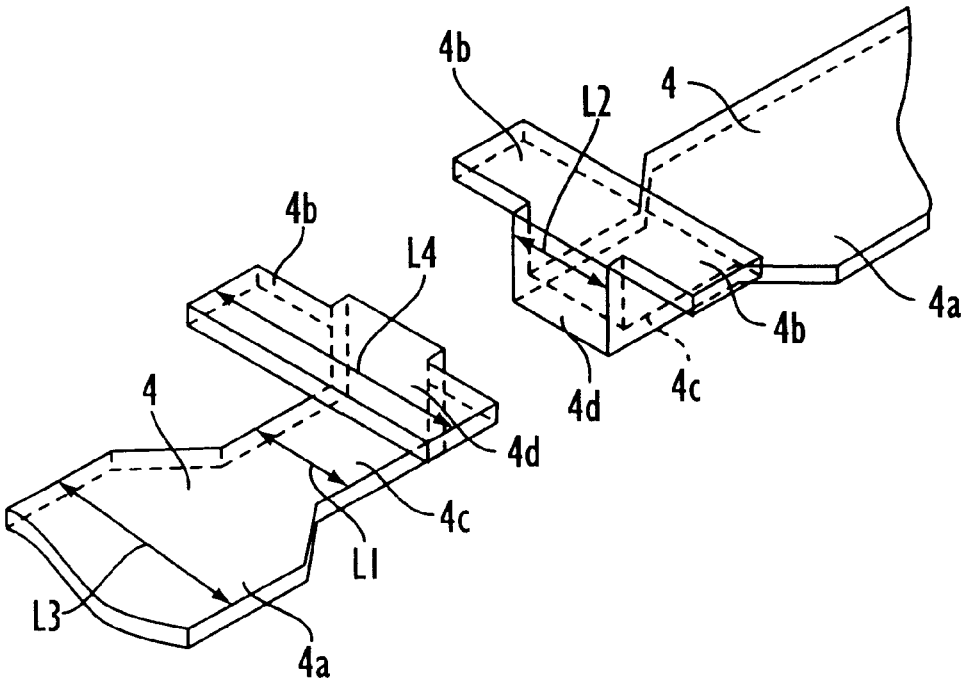
FIG. 7 is an enlarged perspective view of an important section of an exemplified embodiment of the metal terminals as used in a chip inductor of the present invention.
Figure 8:
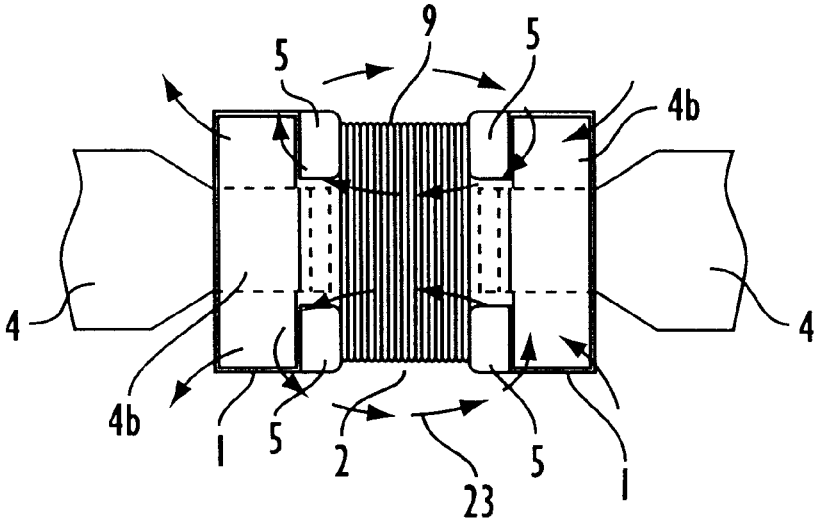
FIG. 8 is a schematic plan view of a chip inductor using the metal terminals of the present invention to show how magnetic fluxes pass through the chip inductor.

Next, a third exemplary embodiment of the present invention will be explained with the help of the drawings (FIGS. 7 and 8).

FIG. 7 is a Perspective view of an example of the metal terminal for a chip inductor of the present invention.

FIG. 8 is a plan view of a chip inductor constructed by use of metal terminals of the present invention, accompanied by the patterns of magnetic flux paths.

A first end part 4*a* of a metal terminal 4 is the part that is sticking out from the outer side surface 3 of a bobbin 2, and a second end part 4*b* is the part that is being bent along the upper side surface 6 of a flange 1 formed at each of the both ends of the bobbin 2.

For use inside the flange 1, are formed a first middle part 4*c* and second middle part 4*d* of the metal terminal 4.

The width (L1) of the first middle part 4*c* is almost the same as the width (L2) of the second middle part 4*d*.

The width (L3) of the first end part 4*a* is almost the same as the width (L4) of the second end part 4*b*.

The width (L1) of the first middle part 4*c* and width (L2) of the second middle part 4*d* are, respectively, about one half of the width (L3) of the first end part 4*a* and width (L4) of the second end part 4*b*.

The metal terminals 4 are made of phosphor bronze or iron plated with solder, silver or the like.

Using these metal terminals 4, a bobbin 2 for a winding is insert-molded in the same way as was described in Example 1.

Then, a winding 9 is disposed on the bobbin, connection by means of solder 11 is performed, and finally an exterior enclosure 12 is provided.

Thus, a chip inductor as shown in FIG. 3 is completed.

FIG. 8 shows how magnetic fluxes pass through the chip inductor thus produced.

It is clearly shown in FIG. 8 that the metal terminals 4 do not interfere with the paths of the magnetic fluxes 23 produced by the winding 9.

As a matter of fact, the Q-Factor characteristics of a 15 nH chip inductor thus structured have shown a 15% improvement over the chip inductor having the widths (L1), (L2), (L3) and (L4) of the metal terminals 4 made all the same, resulting in an enhanced performance for the chip inductor.

Besides, the degree of meshing between the resin used for the bobbin 2 and metal terminal 4 is intensified, and the terminal pulling strength has been increased by 10%, resulting in enhanced reliability for the chip inductor.

In addition, on account of the larger width (L2) of the second end part 4*b*, the connection between the second end part 4*b* and end part 10 of the winding 9 by means of solder 11 is securely performed, thereby further achieving enhanced reliability.

Besides, the mountability as an inductive component proves excellent.

With the present example, the width (L1) of the first middle part 4*c* and also the width (L2) of the second middle part 4*d* both situated inside the flange 1 are made, respectively, about one half of the width (L3) of the first end part 4*a* and width (L4) of the second end part 4*b*, but these dimensions in width should be made optimal according to the distribution of the magnetic fluxes 23, dimensions of the bobbin 2 or the like.

However, it is desirable to have the width of the metal terminal that passes inside the flange made smaller than the width of the metal terminal that is situated outside the flange.

Example 4

Next, a fourth exemplary embodiment of the present invention, will be explained with the help of the drawings (FIGS. 9–12).

Figure 9:
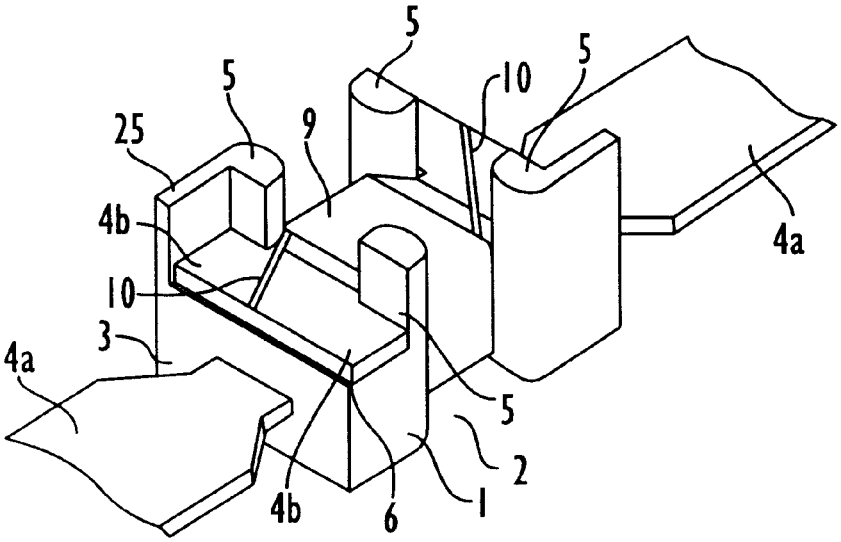
FIG. 9 is a perspective view of still another exemplified embodiment of a chip inductor of the present invention.

FIG. 9 is a perspective view of a fourth example of an insert-molded bobbin for a chip inductor of the present invention.

Figure 10:
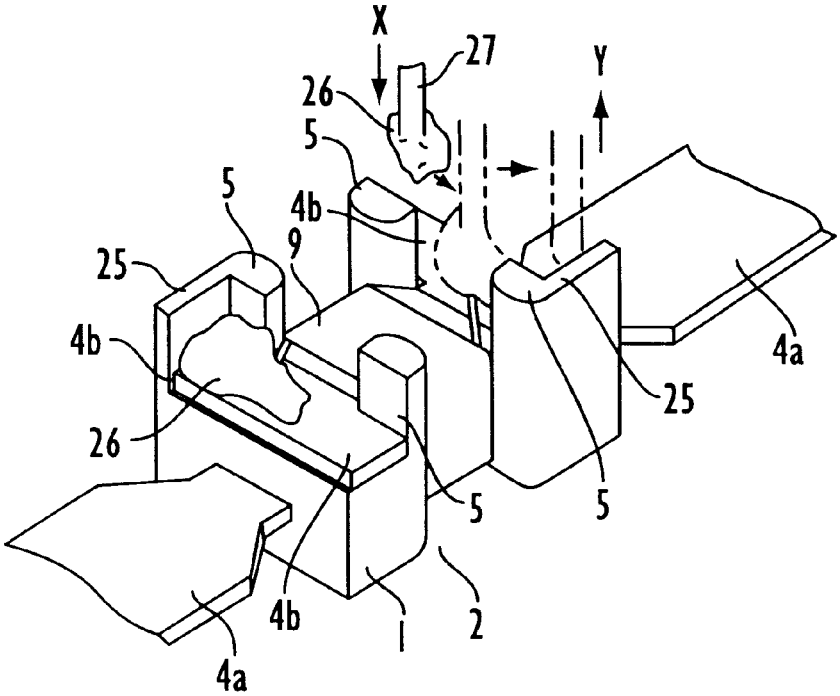
FIG. 10 is a perspective view to show an exemplified embodiment of a step for applying cream solder to connect a winding in the manufacturing process of the chip inductor of FIG. 9.

FIG. 10 is a perspective view of an example of the solder cream application process employed after disposing a winding on the bobbin of the foregoing fourth example.

Figure 11:
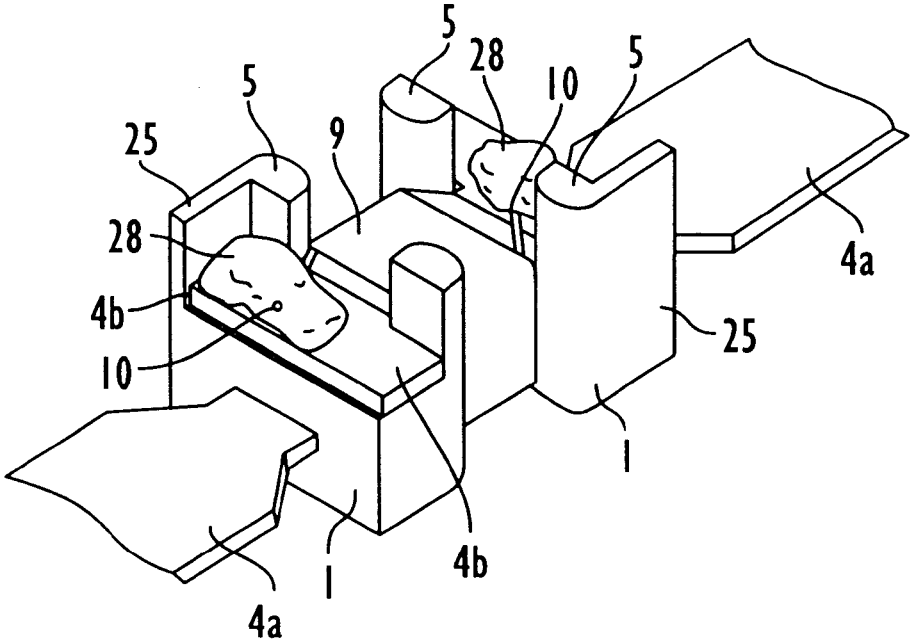
FIG. 11 is a perspective view of stagnant solder after the end part of the winding and internal connection terminal have been connected by solder in the manufacturing process of the chip inductor as shown in FIG. 9.

FIG. 11 is a Perspective view to show how solder gathers after a solder connection between the winding's end part and the internal connection terminal is performed when the bobbin of the fourth example is used.

Figure 12:
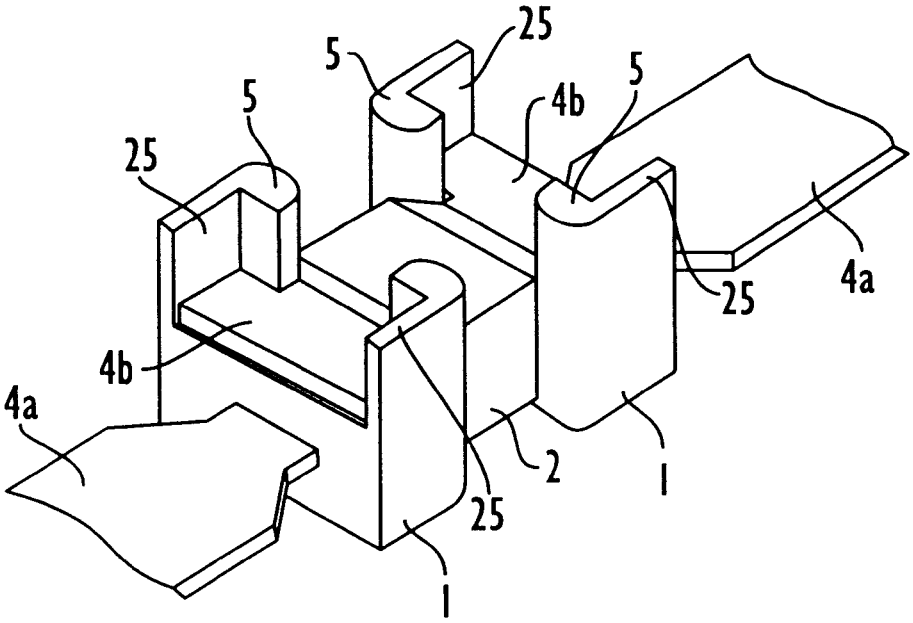
FIG. 12 is a perspective view of still another exemplified embodiment of the manufacturing step for the bobbin for winding as insert-molded for use in a chip inductor of the present invention.
Figure 13:
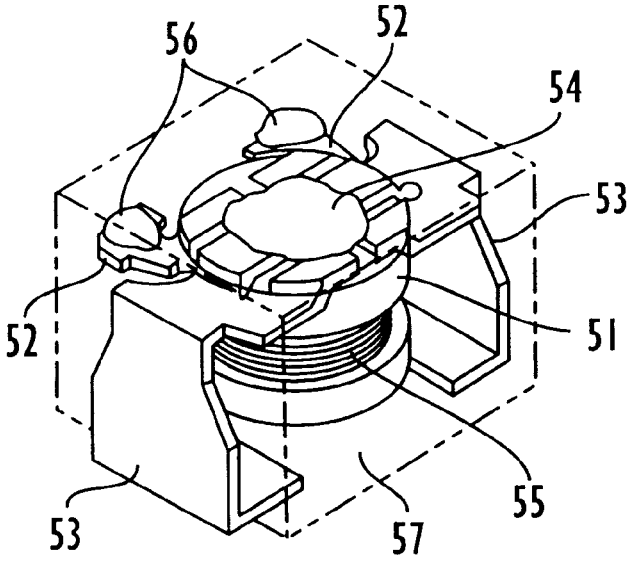
FIG. 13 PRIOR ART
FIG. 13 is a see-through perspective view of a prior art chip inductor to show its internal structures.
Figure 14:
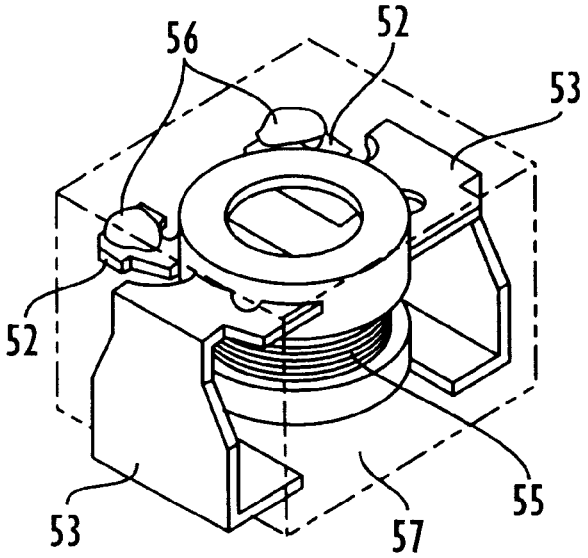
FIG. 14 PRIOR ART
FIG. 14 is a see-through perspective view of another prior art chip inductor to show its internal structures.

FIG. 12 is a perspective view to show another exemplary embodiment of the fourth example of the insert-molded bobbin for a chip inductor of the present invention.

In FIG. 9, a chip inductor comprises a bobbin 2 with a flange 1 formed at each of the ends of the bobbin a winding 9 disposed around the bobbin 2, metal terminals 4 connected to both ends of the winding 9, respectively, and an exterior enclosure 12 not shown encasing the winding 9.

A square-shaped flange 1 is formed at each of the ends of the bobbin 2.

This bobbin 2 having the flanges 1 is made of a resin material.

The resin material used is an electrically insulating and heat resistant resin material such as polyphenylenesulfide, polyphenylene oxide and liquid crystal polymer.

The metal terminal 4 is inserted in the flange 1 situated at each respective end of the bobbin 2 and the first end part 4*a* and second end part 4*b* of the each respective metal terminal 4 sticks out of the flange 1.

The metal terminal 4 is bent upward near the inner side within the flange 1, and the second end part 4*b* pierces through to the upper surface of the flange 1 and then is bent along the upper side surface 6.

The first end part 4*a* of the metal terminal 4 sticks out of the outer side surface 3 of the flange 1.

The metal terminal 4 is made of an electro-conductive material such as phosphor bronze, iron or the like plated with solder, silver and the like.

On the inner edges of the upper side surface 6 of the flange 1 are disposed two studs 5, respectively.

As if surrounding the edges of the second end part 4*b* of the flange 1, a wall 25 forming a solid single body with a stud 5.

After the winding 9 is disposed on the bobbin 2, cream solder 26 is applied on the foregoing metal terminal 4 by means of a solder cream application pin 27 along the X direction, as shown in FIG. 10.

After the foregoing step of solder cream application, the solder cream application pin 27 is pulled up in the Y direction while the application pin 27 is kept in contact with the wall 25.

Accordingly, the cream solder 26 is made repellent against the solder cream application pin 27, resulting in uniform application of the solder cream 26.

In other words, a variation in thickness of the solder cream applied used to be about ±40% in the past for 1 mg of the furnished solder cream 26, but it has been improved to about ±10% with the present example.

As a result, conditions for the subsequent step of solder connection performed by means of a soldering iron, laser or the like is satisfied.

Further, as illustrated in FIG. 11, the state of solder gathering 28 that appears after the soldering for connection between the end part 10 of the winding 9 and metal terminal 4 is well maintained due to the existence of the wall 25.

Although the wall 25 that surrounds a part of the second end part 4*b* of the metal terminal 4 is formed on the edge of only one of the two studs 5 in FIG. 11, it is also possible to employ the structures wherein the wall 25 is formed on both of the two studs 5 as shown in FIG. 12, while achieving the same effect.

Next, an exterior enclosure 12 (not shown) is provided, and the first end part 4*a* sticking out of the outer side surface 3 of the flange 1 situated at each respective end of the bobbin 2 is formed to a specified shape.

Thus, a chip inductor as shown in FIG. 4 is finished.

According to the foregoing structures, the cream solder 26 supplied from the solder cream application pin 27 is cut off well, and the amount of supply of the solder cream 26 is made uniform.

As a result, the conditions for solder connection using a soldering iron, laser or the like are stabilized, and also the solder gathering 28 that appears after performing solder connection between the end part 10 of the winding 9 and second end part 4*b* of the metal terminal 4 is well maintained.

Consequently, it is made possible to supply chip inductors having excellent mass-producibility and enhanced reliability.

In addition, the use of liquid crystal polymer as the material for the bobbin 2 makes it possible to prevent burrs from being formed on the second end part 4*b* of the metal terminal 4 even when the wall 25 is made very thin in thickness. Consequently, it has been made possible to design the second end part 4*b* of the metal terminal 4 to have larger dimensions.

As a result, a supply of chip inductors showing stabilized mass-producibility and excellent reliability has been made possible.

As described above in greater details, a chip inductor of the present invention comprises:

(a) a bobbin having a square-shaped flange at each of the both ends thereof;

(b) metal terminals each comprising:

(1) a first end part sticking out from the outer side surface of the above flange;

(2) a second end part sticking out from the upper side surface of the above flange, and being bent along the foregoing upper side surface; and (3) a embedded part formed inside the above flange; and (c) a winding disposed around the above bobbin, and further, having the end part of the foregoing winding connected to the second end part of the above metal terminal.

The examples described above provide a number of significant advantages.

The foregoing structures make the chip inductor small in dimensions without requiring any extra space.

Besides, any gates do not remain when bobbins are molded, thereby contributing to the prevention of troubles from happening when molding the exterior enclosure and the further miniaturization of the chip inductors.

Also, the metal terminal (the second end part) exposed to the upper surface of the flange is appropriately separated from the other metal plate terminal (the first end part), and, when the winding's end part is connected to the metal plate terminal, molten solder does not flow out along the metal terminal.

Therefore, changing in the thickness of the metal terminal (the first end part) sticking out from the outer side surface of the flange due to the deposition of molten solder does not take place and solder connection is performed without causing any adverse effect to the molding die used in the subsequent step of providing an exterior enclosure.

Further, since the beginning and ending of the winding are located on the flanges different from each other, inductance is established without increasing any distributed capacitance existing between windings of the finished chip inductor even when the number of wire turns is small.

As a result, excellent Q-Factor characteristics can be realized with the finished chip inductor.

Still further, when the bobbin for a winding is insert-molded, a groove is formed at the same time on the side surface of the flange, and the use of a die for forming the foregoing groove and a die for pressing the metal terminal (the second end part) so as to be bent toward the upper surface of the flange and covering the foregoing groove eliminates the troubles caused during the molding process of the bobbin with the metal terminal inserted therein, and, moreover, prevents molding burrs from depositing on the metal terminal (the second end part).

As a result, a secure connection between the end part of the winding and metal terminal (the second end part) situated on the upper surface of the flange can be performed, thereby enhancing the stability of the connection and realizing high reliability.

Besides, by having the width of the metal terminal embedded inside the flange made smaller than the width of the metal terminal that is exposed outside the flange, better reliability in the connection between the end part of the winding and metal terminal exposed on the upper surface of the flange as well as better mountability as an inductive component is realized, and, in addition, the magnetic flux distribution is not disturbed by the existence of the metal terminal piercing through the flange, resulting in realization of a chip inductor having excellent Q-Factor characteristics.

Moreover, the use of a bobbin design wherein the stud on the upper side surface of the flange is provided with a wall surrounding a part of the end part of the metal terminal prevents the flowing out of molten solder at the time of connecting the end part of the winding to the metal terminal, resulting in realization of stabilized gathering of the molten solder.

In addition, when cream solder is supplied by means of a cream solder application pin or the like, a good separation between the pin and cream solder is maintained, thereby keeping the amount of solder cream supply constant with a resultant effective contribution to stabilized connecting conditions that enable secure solder joining to take place.

As a result, enhanced reliability is achieved.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of the invention.

What is claimed is:

1. A chip inductor comprising:

(a) a bobbin having a square-shaped flange at each respective end of the two ends thereof;

(b) a metal plate terminal comprising:

(1) a first end part sticking out from the outer side surface of said flange;

(2) a second end part sticking out from the upper side surface of said flange, and being bent along said upper side surface; and (3) a buried part buried inside said flange; and (c) a winding disposed around said bobbin, an end part of said winding is connected to said second end part of said metal terminal;

wherein a groove is formed on each respective surface of the two side surfaces situated next to the upper side surface of said flange, and said second end part of said metal terminal is arranged so as to cover said groove.

* * * * *